US005540122A

United States Patent [19]

Lund

[11] Patent Number: 5,540,122

[45] Date of Patent: Jul. 30, 1996

[54] TORQUE TRANSFER TOOL

[75] Inventor: David R. Lund, Charleston, S.C.

[73] Assignee: Victory in Jesus Ministries, Inc., Charleston, S.C.

[21] Appl. No.: 242,196

[22] Filed: May 13, 1994

Related U.S. Application Data

[63] Continuation-in-part of Ser. No. 75,787, Jun. 14, 1993, abandoned.

[51] Int. Cl.[6] ..... B25B 17/00

[52] U.S. Cl. ..... 81/57.3; 81/57.14

[58] Field of Search ..... 81/57.14, 57.3, 81/57.43

[56] References Cited

U.S. PATENT DOCUMENTS

| | | | |
|---|---|---|---|
| 2,672,065 | 3/1954 | Danuskie | 81/57.3 |
| 3,138,983 | 6/1964 | Frizzell | 81/57.3 |
| 3,283,621 | 11/1966 | Faso | 81/57.34 |
| 3,714,852 | 2/1973 | Giangrasso | 81/57.3 |
| 4,184,390 | 1/1980 | Evans | 81/57.3 |
| 4,827,809 | 5/1989 | Broemel | 81/57.3 |

*Primary Examiner*—James G. Smith
*Attorney, Agent, or Firm*—B. Craig Killough

[57] ABSTRACT

A torque transfer tool which allows a torque input at one point of the tool, with the torque transferred to another point of the tool. Gears are connected by a direct drive means, contained within an elongate housing having a dog bone shape which is formed by gear housings on opposite ends of the elongate housing which are connected by a central housing. Chain guides are present on the interior of the housing where the gear housings join the central housing.

2 Claims, 3 Drawing Sheets

TORQUE TRANSFER TOOL

This application is a continuation-in-part of application Ser. No. 08/075,787, filed Jun. 14, 1993, abandoned.

FIELD OF THE INVENTION

This invention relates to tools generally, and is more particularly directed to a tool which is used to transfer torque.

BACKGROUND OF THE INVENTION

Threaded fasteners are used in a wide variety of applications. Threaded fasteners include screws, capscrews, nuts, bolts, and the like. The threads of the fastener engage other threads of an object or another fastener by means of the application of torque to the fastener or the head of the fastener. With many fasteners, such as with capscrews or bolts, sufficient torque is applied to the fastener head to elastically stretch the fastener to properly and sufficiently provide fastening.

Tools are used to apply torque to fasteners. These tools may be hand tools or Dower tools. Such tools include screwdrivers, hand wrenches, ratchet wrenches and pliers.

In most cases, the tool engages the head of the fastener. In the case of a screwdriver, the end of the screwdriver engages the head of the tool directly. In the case of hand wrenches, the open end or box end of the hand wrench engages the head of the fastener. In the case of ratchets, or power air tools, a socket engages the head of the fastener directly.

In the case of ratchets and power tools, the socket is attached to a tool. A drive means, which may be a ratchet or power tool, is attached to the socket to apply torque to the socket. Extensions which connect the ratchet or power tool to the socket have been used in the art. However, these extensions extend along the line of the axis of the socket and rotate on the same axis as the socket.

Various torque transfer tools are disclosed in the prior art. A common problem with torque transfer tools using chain type drive means, such as bicycle chain, is a "pile up" of the chain as the chain is pushed by the drive gear onto the driven gear. While various references such as Giangrasso, U.S. Pat. No. 3,714,852, use chain tensioners and the like, such devices are relatively complex and less satisfactory than the present invention.

A housing having an oval shape, such as shown in the prior art references, Frizzell, U.S. Pat. No. 3,138,983, Giangrasso, U.S. Pat. No. 3,714,852 and Danuskie, U.S. Pat. No. 2,672,065, tends to flex at the point where the sprocket housing joins the elongate housing. This flex is not desired in the invention, and can lead to an undesired loss of torque, breakage of the housing, and improper engagement of, or breakage of, the chain.

SUMMARY OF THE PRESENT INVENTION

The present invention is a tool which transfers torque from a drive tool, such as a ratchet, to an object tool, such as a socket, along a path of travel which is not on the same axis as the rotation of the drive tool. An object tool is attached to one end of the invention, and a drive tool is attached to an opposite end. The housing 2 of the present invention is held stationary, with the object tool positioned to apply torque to the fastener, A drive tool is attached to an opposite end of the device, and torque is transferred from the drive tool to the object tool and the fastener by the invention.

The present invention allows a user to employ a ratchet or power tool in applications where there is insufficient working space to position a ratchet or power tool. The power tool or ratchet may be positioned at a remote location, with torque transferred from the ratchet power tool transferred to the object tool and fastener by means of the device.

The device may also be used to transfer torque in other applications where the object tool functions by means of rotation, such as a drill.

The dog bone shape of the present invention is important to the proper operation of the present invention. As the narrower elongate, central housing opens into the larger gear housing, the drive means or chain is positioned into the teeth. This smaller width of the elongate, central housing, relative to the larger gear housings places the drive means or chain onto the gears in a more positive manner than if the width of the central elongate member were the same as the diameter of the gear housing, as shown in the devices of the prior art such as Frizzell, U.S. Pat. No. 3,138,983, Giangrasso, U.S. Pat. No. 3,714,852 and Danuskie, U.S. Pat. No. 2,672,065. The dog bone shape, which provides a narrower central elongate member, directs the chain onto the drive gear, and helps prevent this "pile up" as would be experienced with the prior art devices of Frizzell, U.S. Pat. No. 3,138,983, Giangrasso, U.S. Pat. No. 3,714,852 and Danuskie, U.S. Pat. No. 2,672,065, without using idler gears or other complex structures.

The dog bone shape provides more structural integrity at this critical point, since the radius of the housing, which is excess of 180 degrees, provides additional housing material, and therefore strength, at this point of flexing.

The dog bone shape, by having a narrower, central elongate member achieves weight reduction of the overall tool.

The dog bone shape, by using a narrower, central elongate member, with enlarged ends, provides a shape which is easier for the manual user to grip.

The use of the chain guides to direct the chain onto and off of the gears further helps to eliminate a pile up of the chain.

DESCRIPTION OF THE PREFERRED EMBODIMENT

Figure 3:
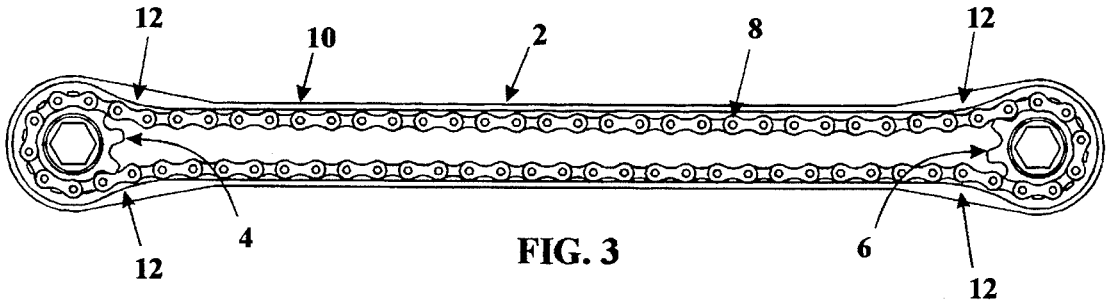
FIG. 3 is a top plan view of the tool with a top portion of the housing removed to show the drive means and gears.

Referring now to the drawing figures, the device is characterized by an elongate housing 2. As shown in FIG. 3, the elongate housing contains a first gear 4 and a second 6 gear located therein. The first gear and the second gear are located near ends of the housing 2. The first gear and the second gear are mounted within the housing so that the gears are free to rotate within the housing.

First gear 4 and second gear 6 are connected by drive means 8. Drive means 8 engages the first gear and second gear and connects first gear 6 and second gear 8 so that first gear and second gear communicate with each other to rotate simultaneously as torque is applied.

As shown in FIG. 3, drive means may be a chain. Any chain or belt which will engage a gear or sprocket or pulley could be used. The chain or other drive means is flexible. The drive means has engagement means to engage first gear 4 and second gear 6.

As shown, a common chain, such as used on a bicycle, may be employed. This type of chain is commonly known as roller chain or bicycle chain.

Figure 1:
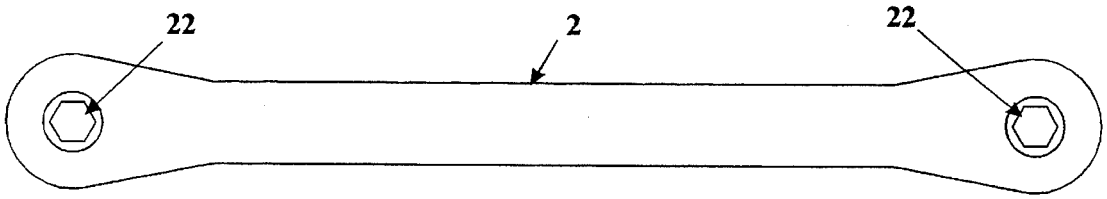
FIG. 1 is a top plan view of the tool
Figure 2:
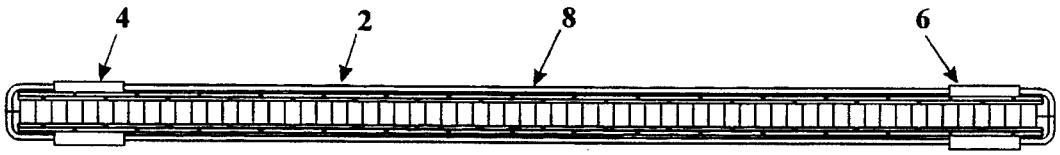
FIG. 2 is a side elevation of the tool, with the housing sectioned to reveal the drive means.

Other gear configurations, or pulleys, could be used. The gears could have teeth or splines. The flexible drive means could have links which are engaged by the teeth, or splines which engage a gear or pulley. The particular design must be sufficient to handle the torque applied to the tool according to the application. As shown in the drawings, the preferred shape of the device, when viewed in a top plan view such as FIG. 1, and as dictated by the housing, is a dog bone shape. The dog bone shape has an elongate central member 10 which is enlarged at each end to form a first gear housing 5 and a second gear housing 7. The gear housing as shown in the drawing figures is of a constant, concentric radius which then tapers to a reduced size to intersect the gear housings 5,7 at each end of the elongate member. The first gear housing and the second gear housing are of a diameter which is greater than the width of the central housing, and accordingly, as the housings 5,7 intersect the central, elongate member, the width of the housings reduces to intersect and form the central member 10. This resulting, preferred shape resembles a dog bone, and accordingly, it is defined as a dog bone shape, with the ends of the dog bone forming the enlarged gear housings about the ends of the narrower central elongate member.

As the narrower elongate, central housing opens into the larger gear housing, the drive means or chain is positioned into the teeth. This feature is demonstrated in FIGS. 3 and 6, as the teeth are placed into the gear with the aid of the housing which is of smaller width than the diameter of the gear housing when viewed as in FIG. 3. This smaller width of the elongate, central housing, relative to the larger gear housings places the drive means or chain onto the gears in a more positive manner than if the width of the central elongate member were the same as the diameter of the gear housing, as shown in the devices of the prior art such as Frizzell., U.S. Pat. No. 3,138,983, Giangrasso, U.S. Pat. No. 3,714,852 and Danuskie, U.S. Pat. No. 2,672,065.

Chain guides 12 are formed on the interior of the housing. The chain guides are formed on the sides of the housing where the gear housings join the central elongate member. In the preferred embodiment, there are four chain guides formed in the housing. Each gear has a point of entry into and a point of exit from the drive means, and a chain guide is located near each of such points on the housing for each gear.

The chain guides tension the drive means and guide the drive means as the drive means enters and exits the gears. In this manner the chain guides reduce "piling up" of the drive means. The drive means is also directed onto the gear for proper engagement of the drive means with the gear teeth, and the drive means is properly aligned as it travels down the central elongate member to the next chain guide.

Figure 4:
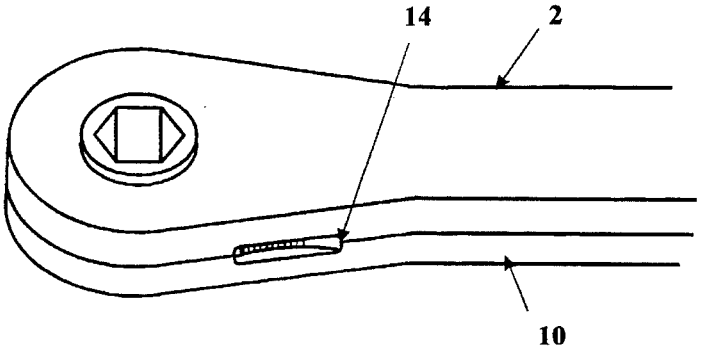
FIG. 4 is a enlarged, partial view of the tool.
Figure 5:
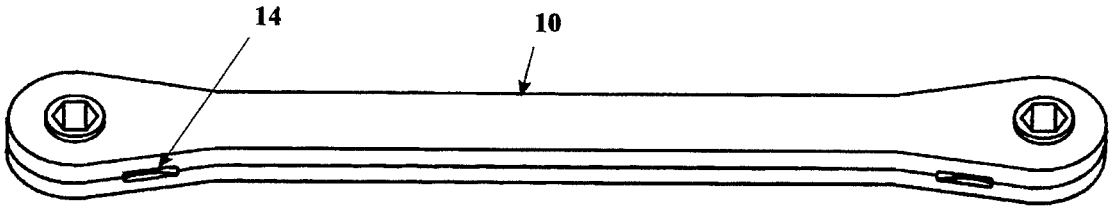
FIG. 5 is a perspective view of the tool.
Figure 6:
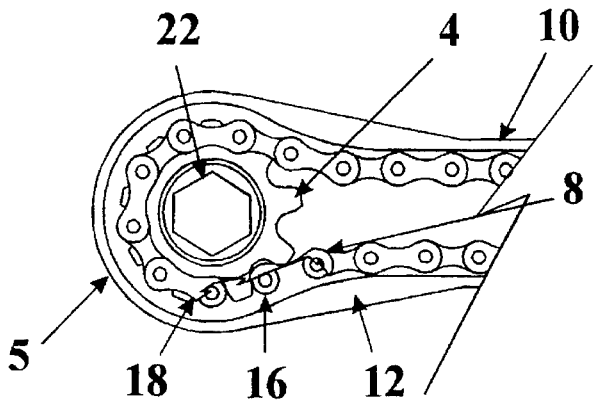
FIG. 6 is a enlarged partial view of the tool.
Figure 7:
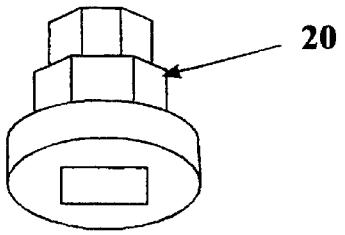
FIG. 7 is a drive plug which is used with the tool.
Figure 8:
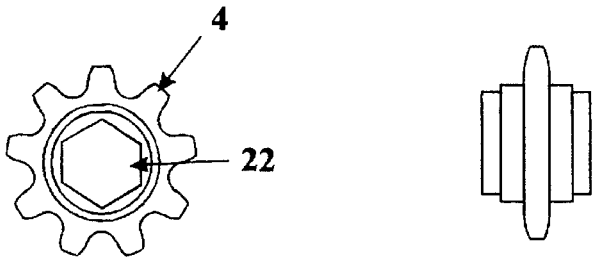
FIG. 8 is an isolation of a drive gear of the tool.

In the preferred embodiment, the chain guide is a detent 14 formed by permanently displacing a side wall of the housing in an arcuate shape into the interior of the housing, so that the chain guide 12 extends from the side wall of the interior of the housing into the housing to contact the chain. The size and position of the detent so formed is determined by the drive means. When roller chain is used as the drive means, the rollers 16 of the chain should roll on the surface of the detent, with the link plates 18 of the chain passing above and below the detent. FIG. 6. Accordingly, the height of the detent, when viewed from the side, FIG. 4, is smaller than height of the roller.

In use, the first gear is rotated by application of torque from a drive tool. The drive tool could be any known drive tool, including a wrench, ratchet, screwdriver, or a power tool which will apply a rotational force to the gear. The power tool could be a pneumatic wrench or an electrically powered wrench. In the most common application, the rectangular drive of a ratchet or air powered impact wrench will be engaged within a void in the gears. As the first gear rotates, the gear engages the drive means, and the drive means is pulled in the direction of rotation of the gear, causing a like rotation of the drive means. The gears are engaged by the drive means, which rotates within the gear for somewhat more than 180°, whereupon it is discharged from the gear to contact the chain guide.

The rotation of the drive means by the first gear causes rotation of the second gear. In this manner, torque is applied to the second gear. An object tool is attached to the second gear. The object tool may be a socket, a screwdriver blade, or other tool which engages a head of a fastener, or the object tool could be any tool which operates by rotation, such as a drill.

The drive means in the embodiment as shown engages the second gear in the same manner in which the first gear is engaged. It is not necessary that the second gear be identical in design to the first gear. For the purpose of increasing or decreasing torque, or increasing or decreasing rotational speed, gears of different effective diameters may be employed.

The housing is enlarged at the ends retain the gears. Material having low frictional or having lubricational qualities may be provided on the surfaces of the gears or a portion of the housing in which the gears are maintained.

In the preferred embodiment, the gears have a concentric hexagonal void 22. A drive plug 20 inserted into the void 22. The drive plug has a rectangular void which is of a dimension which will engage a drive of a conventional tool such as a ratchet or a power tool. The hexagonal voids of the drive gears may be of differing dimensions to accommodate different sizes of fastener heads. The use of the drive plug, with its steps of differing hexagonal dimensions, allows the drive tool to be connected to hexagonal voids of different dimensions within a single tool, or within torque transfer tools of other sizes.

The first gear may be designed to engage a drive tool, such as ratchet. Accordingly, the first gear may have a void therein which accepts engagement from the drive tool. Most commonly, this void will be of rectangular cross section and of a common size for ratchet or power tool drives. However, the first drive gear could have other configurations for the acceptance of drive tools. For example, the first gear could have a slot for the acceptance of engagement of a screwdriver, or could have a protrusion for engagement with a chuck which is attached to a drill motor. Any other configuration could be used to accommodate various drive means.

The second drive Gear may be configured to accept an object tool. Most commonly, this configuration will be a protrusion as a male engagement into a socket having a rectangular void of common size for ratchet or power tool drives. However a drill chuck could be provided for the insertion and mounting of bits, including drills and screwdrivers, or for various types of blades. Other configurations for the mounting of tools could be provided.

It is not necessary that the gears rotate within the same plane. The application of torque may be directed to position the drive tool to rotate on a plane which is perpendicular to, or otherwise different than, the plane within which the first gear rotates. One or more idler gears could be used to facilitate such directional change.

The housing, or a portion thereof, may be flexible. The use of a flexible material, or a bellows type material, allows an end of the tool to flex to assist reaching a fastener which is located in a difficult position.

Two or more of the tools may be coupled to give even greater length and flexibility. The device may be used to apply torque to fasteners which are difficult to reach because of space limitations. The device also may be used to reach fasteners which are overhead, without the use of ladders or scaffolding, thereby reducing the risk of injury to workers from falls.

What is claimed is:

1. A tool for transferring torque, comprising:

a. a housing having an elongate central member which is enlarged at an end thereof to form a gear housing;

b. a first drive gear rotationally mounted within said gear housing;

c. a second drive gear rotationally mounted within said housing;

d. a roller chain engaging said first drive gear and said second drive gear and which connects said first drive gear with said second drive gear and provides communication between said first drive gear and said second drive gear; and e. a guide which extends into an interior of said housing where said gear housing joins said elongate central member, wherein, in use said guide engages rollers of said roller chain, and link plates of said roller chain pass above said guide.

2. A tool for transferring torque as described in claim 1, wherein, in use, the link plates of said roller chain pass above and below said guide.

* * * * *